US006444389B1

(12) United States Patent
Ninomiya et al.

(10) Patent No.: US 6,444,389 B1
(45) Date of Patent: Sep. 3, 2002

(54) TONER FOR DEVELOPING ELECTROSTATIC LATENT IMAGE, TWO-COMPONENT DEVELOPER AND IMAGE-FORMING PROCESS

(75) Inventors: Masanobu Ninomiya; Yasuhiro Oya; Hidekazu Yaguchi; Hirokazu Hamano; Haruhide Ishida, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/706,800

(22) Filed: Nov. 7, 2000

(30) Foreign Application Priority Data

Jan. 14, 2000 (JP) ..... 2000-007220

(51) Int. Cl.[7] ..... G03G 9/087

(52) U.S. Cl. ..... 430/110.3; 430/108.6; 430/108.7; 430/111.4; 430/124; 430/126

(58) Field of Search ..... 430/111.4, 108.6, 430/108.7, 110.3, 109.3, 109.4, 107.1, 45, 109, 110, 111, 99, 124, 126

(56) References Cited

U.S. PATENT DOCUMENTS 5,659,857 A * 8/1997 Yamazaki et al. ..... 430/45

5,660,995 A * 8/1997 Moriyama et al. ..... 430/108.7

FOREIGN PATENT DOCUMENTS

| | | |
|---|---|---|
| JP | 52-30437 | 3/1977 |
| JP | 54-20344 | 7/1979 |
| JP | 58-27503 | 2/1983 |
| JP | 2-22668 | 1/1990 |
| JP | 4-57062 | 2/1992 |
| JP | 6-332247 | 12/1994 |
| JP | 8-220800 | 8/1996 |
| JP | 10-207126 | 8/1998 |
| JP | 10-268558 | 10/1998 |
| JP | 11-24313 | 1/1999 |

* cited by examiner

*Primary Examiner*—Janis L. Dote
(74) *Attorney, Agent, or Firm*—Oliff & Berridge, PLC

(57) ABSTRACT

A toner for developing an electrostatic latent image contains a binder resin, a colorant, a wax, and inorganic fine particles. The toner contains the inorganic fine particles content in the range from 1 to 10% by weight, the temperature at which the complex viscosity η° of the toner in the case of measuring at a frequency of 100 rad/second shows 1000 Pa.s ranges from 125 to 145° C., and the temperature at which the complex viscosity η° of the toner in the case of measuring at a frequency of 100 rad/second shows 100 Pa.s ranges from 180 to 210° C.

19 Claims, No Drawings

TONER FOR DEVELOPING ELECTROSTATIC LATENT IMAGE, TWO-COMPONENT DEVELOPER AND IMAGE-FORMING PROCESS

FIELD OF THE INVENTION

The present invention relates to a toner for developing an electrostatic latent image (hereinafter, is sometimes referred simply to as toner) utilizing an electrophotographic process or an electrostatic recording process, a two-component developer containing the toner, and an image-forming process using the toner.

BACKGROUND OF THE INVENTION

Hitherto, in the case of forming images in a copying machine, a laser beam printer, etc., a Carlson process is generally used. In an image-forming process by a black and white electrophotographic process of related art, after developing an electrostatic latent image formed on a photoreceptor by an optical method in a developing step, the developed image is transferred to a recording medium such as a recording medium, etc., in a transfer step, and then the transferred image is fixed to the recording medium such as the recording paper, etc., generally by heat and pressure in a fixing step to obtain a black and white image.

However, in the recent electrophotographic technique, the progress of from back and white to full color has been rapidly progressed. In the color image formation by a full color electrophotographic process, the regeneration of colors is generally carried out using four-color toners composed of three-color toners of yellow, magenta, and cyan, which are the three primary colors, added with a black color toner. In a general full color electrophotographic process, first, an original is color-separated in yellow, magenta, cyan, and black and per each color, an electrostatic latent image is formed on a photoconductive layer. Then, a toner image is held on a recording medium through a development and a transfer steps. Then, the steps are successively repeated plural timers per each color, and while matching the positions of the toner images each having each different color, the toner images each having each different color are overlapped on a same recording medium. Also, by applying one fixing process, a full color image is obtained. The point of overlapping several kinds of toner images each having a different color as described above is a large different point between the black and white electrophotographic process and the full color electrophotographic process. In the color toners used for the full color electrophotographic process, it is necessary that the toners of many colors are sufficiently mixed in the fixing process and by sufficiently mixing these multicolor toners, the color reproducibility and the OHP transparency are improved, and a full color image having a high image quality can be obtained. Thus, as compared with a black toner for black and white print, it is desired that the color toners are generally formed by a sharp melting low-molecular weight resin to increase the color mixing property.

In the black toner for the black and white prints of related art, because the toner image is brought into contact with a fixing unit such as a heat roller, etc., in a heat-melt state at fixing, for preventing the occurrence of a so-called offset phenomenon that a part of the toner image attaches and transfers to the surface of the heat roller, the black toner contains therein a wax having a high crystalline property and a relatively high melting point, such as polyethylene, polypropylene, etc. In general, in the case of a high viscous toner such as the black toner for the black and white prints, because the intermolecular cohesive force at heat-melting of the toner is strong, the occurrence of the offset phenomenon can be prevented by oozing out a small amount of the wax. However, when it is necessary to color by overlapping toners of two or more colors such as full color toners and to form a flat fixed image surface for giving a transparency of an OHP image, it is required to lower the viscosity of the toners and increase the heat-melting property of the toners. In this case, for obtaining a sufficient effect for the anti-offset property, it is necessary to add a large amount of wax to the toners. However, because in the case of the toners prepared by a melt-kneading/grinding method, the toners become the structure of exposing the wax onto the surfaces of the toners, whereby a large amount of the wax exposed on the surfaces of the toners causes filming to a photoreceptor and is liable to stain the carrier and the surface of the developing sleeve, and thus the images formed are liable to be deteriorated.

Accordingly, a method has been employed wherein ordinary toners for full color do not contain wax, for the purpose of preventing the occurrence of an offset phenomenon, the surface of heat-fixing roller is formed with a silicone rubber or a fluorine resin excellent in the releasing property to the toners and further a releasing liquid such as a silicone oil, etc., is supplied to the surface of the roller. The method is very effective in the point of preventing the occurrence of the offset phenomenon of toners but there is a problem that an apparatus for supplying an offset preventing liquid becomes necessary. This is against the direction of small sizing and light weighing the image-forming apparatus and also there sometimes occur the problems that the offset preventing liquid is evaporated by heating to give an unpleasant smell and the vapor of the liquid strains the insides of apparatus.

Also, between a black and white image and a full color image, the coated area of the toner on a recording medium (image density) and the weight of the toner per unit area in the recording medium are different. That is, in black and white images mainly for letters, it is rare that the image density becomes large or the weight of the toner per unit area in a recording medium becomes large. On the other hand, in full color images mainly for pictorial images such as pictures, photographs, etc., the case of forming images on the whole surface of a recording medium is increased. Also, because in a full color image, the color image is formed by overlapping color toners of yellow, magenta and cyan as described above, the weight of the toners per unit area in the recording medium becomes large. Accordingly, as compared with a black and white image, in a full color image, the image density becomes high and the weight of toners per unit area in a recording medium becomes large.

In general, when an image density is high in a fixing step, the area that the fixing unit is brought into contact with toners in heat-melt state becomes large, whereby an offset phenomenon of toners is liable to occur. Also, when the weight of toners per unit area in a recording medium in a fixing step is large, the height of the unfixed toners formed on the recording medium becomes high. When the height of the unfixed toners becomes high, there occurs a large temperature difference between the toner of the uppermost surface layer and the toner of the lowermost layer. Therefore, when the toners are sufficiently heated and pressed in a fixing step so that the toner of the lowermost layer is completely melted, heat is excessively added to the toner of the uppermost surface layer, whereby the melt viscosity of the toner becomes too small and an offset phenomenon is liable to occur.

As a method of solving the problem, a method of increasing the pressure at fixing to anchor the toner on a transfer material has been employed. In the method, the occurrence of a high-temperature offset phenomenon of the toner of the uppermost surface layer can be prevented. However, in this case, a separated trace of a member of separating the transfer material from a fixing roller appears in the image formed and further, owing to the high pressure, line images are smashed at fixing, whereby image defects of the copy image are liable to occur.

From the reasons described above, as the color toners for full color, the toners have been investigated which use a sharp-melt low molecular weight resin, contain only a small amount of a low-melting wax, and can be fixed without causing image defects even in the case of a high image density and a large weight of toners per unit area in a recording medium, without supplying a releasing liquid to the surface of a fixing heat roller.

For example, Japanese Patent Laid-Open No. 57062/1992 describes color toners containing a resin having a softening point of flow tester melt viscosity of $10^5$ poise from 90 to 120° C., Mw from 15,000 to 50,000, Mn from 2000 to 10,000, and Mw/Mn from 5 to 15. Also, Japanese Patent Laid-Open No. 207126/1998 describes color toners containing a binder resin having Mw/Mn from 15 to 30, Mw from 15,000 to 70,000, and a softening point of 90 to 120° C. Also, Japanese Patent Laid-Open No. 268558/1998 describes color toners using a polyester resin of a specific composition such that Mw is at least 5000, Mw/Mn is at least 18, and a softening point ranges from 95 to 150° C. However, by only the prescription of the softening point, it is difficult to satisfy both the anti-offset property and the low-temperature fixing property of color toners. The reason is as follows. That is, because the correlation of the viscosity of the toner at low-temperature for the low-temperature fixing property and the viscosity of the toner at high temperature for the anti-offset property is high, by only prescribing the viscosity by a certain specific temperature only, it is difficult to simultaneously satisfy both the properties.

Also, Japanese Patent Laid-Open No. 24313/1999 describes toners containing a binder resin composed of a combination of a resin (1) having Mw from 10,000 to 50,000, Mw/Mn from 2 to 5, and a softening point of 90 to 100° C. and a resin (2) having Mw from 20,000 to 100,000, Mw/Mn from 3.5 to 10, and a softening point of 105 to 135° C. However, in the toners, because the softening point of the resin (1) is too low, when the image density is high and the weight of the toners per unit area in a recording medium is large, image defects occur. Also, because the molecular weight distribution of the resin (2) is too wide, it is difficult to obtain a high glossiness. In the toners, when a fixing condition is changed to sufficiently conduct heat for obtaining a high glossiness, there is a problem that the viscosity of the resin (1) having a low softening point is extremely lowered to cause an offset.

Also, many techniques of adding fine particles in the insides of toners are reported. For example, Japanese Patent Publication No. 20344/1979 discloses an electrophotographic negative-charging powder toner containing a hydrophobic silica fine powder for controlling the charging property of the toner to a negatively charging property. Also, Japanese Patent Laid-Open No. 30437/1977 discloses a fine particle-containing toner for improving an anti-blocking property, and Japanese Patent Laid-Open No. 27503/1983 discloses a fine particle-containing toner for improving the fluidity, etc. However, these inventions are not for controlling the viscoelastic characteristics of the toner.

The techniques of adding fine particles in the insides of toners for controlling the melt viscosity and the viscoelasticity of the toners are described in Japanese Patent Laid-Open Nos. 22668/1990, 332247/1994, 220800/1996, etc. That is, Japanese Patent Laid-Open No. 22668/1990 discloses a toner for flashing fixing obtained by adding an inorganic filler to the toner. The toner is for preventing the occurrence of voids occurring at flashing fixing by increasing the melt viscosity of the toner. Because this is the invention of the toner for flashing fixing, the toner shows sufficient characteristics as the flashing fixing toner for heat/press fixing. However, because there is no prescription about the viscoelastic characteristics necessary to the toner characteristics for heat/press fixing, the construction only of the invention is insufficient for the characteristics as the toner for heat/press fixing.

Japanese Patent Laid-Open No. 332247/1994 discloses a toner obtained by adding organic fine particles to the toner in an amount from 10 to 200% by weight to the binder resin of the toner for improving the fixing characteristics. Because the technique intends to the improvement the fixing characteristics of the black and white toner, even when the fine particles are added to the toner in a large amount from 10 to 200% by weight to the binder resin of the toner, there is no problem in regard to the fixing characteristics. However, when such a large amount of fine particles are added in the toner, the surface of the fixed image is not unified and the surface of the fixed image having unevenness is formed. In the case of a black and white image, the surface of the fixed image having the unevenness does not give a particular problem, but in a color image, the color reproducing region is narrowed by the unevenness of the fixed image and it becomes difficult to cope with full color. Also, there is a problem that the OHP transparency is lowered by the unevenness of the fixed image.

Japanese Patent Laid-Open No. 220800/1996 discloses a technique of unifying the viscoelastic characteristics of color toners and the viscoelastic characteristics of a black toner by adding inorganic fine particles to the color toners. In the technique, when a monochromatic toner is fixed in one operation, good fixing characteristics can be obtained because the fixing characteristics of each toner are unified. However, by only that the fixing characteristics of each toner are unified, the fixing characteristics of the image (the image of a large weight of the toners per unit area in a recording medium) formed by overlapping plural color toners followed by fixing cannot be satisfied.

SUMMARY OF THE INVENTION

The present invention has been made for solving the above-described problems in the techniques of the related art and provides a toner for developing an electrostatic latent image which can realize images being excellent in the low-temperature fixing property, the OHP transparency, and the anti-offset property without substantially coating oil in heat roll fixing, having a high glossiness, and having no image defects even when the image density is high; a two-component developer containing the toner; and an image-forming process using the toner.

That is, the present invention is as follows.

The 1st aspect of the invention is a toner for developing an electrostatic latent image containing a binder resin, a colorant and a wax. The temperature at which the complex viscosity $\eta^*$ of the toner in the case of measuring at a frequency of 100 rad/second shows 1000 Pa.s ranges from 125 to 145° C., and the temperature at which the complex viscosity $\eta^*$ of the toner in the case of measuring at a frequency of 100 rad/second shows 100 Pa.s ranges from 180 to 210° C.

The 2nd aspect of the invention is a two-component developer containing a carrier and a toner, which toner is the toner of the 1st aspect of the invention described above.

The 3rd aspect of the invention is an image-forming process including a step of forming an electrostatic latent image on a latent image holding member, a step of developing the electrostatic latent image with a toner to form a toner image, a step of transferring the toner image onto a transfer material to form a transferred image, and a step of fixing the transferred image on a recording medium using a fixing apparatus, such as one comprising a heat roller and a press roller. The toner in this aspect is the toner of the 1st aspect of the invention described above, the fixing surfaces of the heat roller and the press roller are formed of a releasing resin, for example, a fluorine resin, and a releasing liquid is not substantially supplied to the fixing surfaces.

Furthermore, as the present invention for solving the problems, the following aspects are preferred.

That is, the 4th aspect of the invention is the toner for developing an electrostatic latent image described above. In this aspect, the binder resin is composed of at least two kinds of binder resins (A) and (B). The temperature at which the complex viscosity η° of the binder resin (A) in the case of measuring at a frequency of 100 rad/second shows 1000 Pa.s ranges from 115 to 130° C., and the temperature at which the complex viscosity η° of the binder resin (B) in the case of measuring at a frequency of 100 rad/second shows 100 Pa.s ranges from 180 to 200° C.

The 5th aspect of the invention is the toner for developing an electrostatic latent image of the 1st or 4th aspect described above. In this aspect, the weight average molecular weight (Mw) of the binder resin (A) ranges from 8000 to 18000, the ratio (Mw/Mn) of the weight average molecular weight (Mw) to the number average molecular weight (Mn) thereof ranges from 2 to 4, and the softening point thereof ranges from 105 to 115° C., and the weight average molecular weight (Mw) of the binder resin (B) ranges from 20,000 to 35,000, the ratio (Mw/Mn) of the weight average molecular weight (Mw) to number average molecular weight (Mn) thereof ranges from 3 to 5, and the softening point thereof ranges from 120 to 140° C.

The 6th aspect of the invention is the toner for developing an electrostatic latent image of one of the 1st, 4th, and 5th aspects described above. The shape factor SF-1 of the toner shown by the following formula (1) ranges from 130 to 160 and the shape factor SF-2 of the toner shown by following formula (2) ranges from 110 to 140.

$$SF-1 = \frac{(\text{The maximum length of the diameter of toner particle})^2}{\text{Area of toner particle}} \times \frac{\pi}{4} \times 100 \quad (1)$$

$$SF-2 = \frac{(\text{Peripheral length of the projected image of toner particle})^2}{\text{Area of toner particle}} \times \frac{1}{4\pi} \times 100 \quad (2)$$

The 7th aspect of the invention is the toner for developing an electrostatic latent image of one of the 1st and 4th to 6th aspects described above, in which the toner is a color toner.

The 8th aspect of the invention is the toner for developing an electrostatic latent image of one of the 1st and 4th to 7th aspects described above. In this aspect, the wax has a melting point in the temperature range from 70 to 100° C. and a melt viscosity from 1 to 200 mPa.s at 110° C., and the wax content of the toner ranges from 5 to 10% by weight.

The 9th aspect of the invention is the image-forming process of the 3rd aspect of the invention. When the toner amount formed on the recording medium is 0.50 mg/cm$^2$, and the glossiness (75 degree gloss) ranges from 40 to 60.

The 10th aspect of the invention is the image-forming process of the 3rd or 9th aspect described above. In this aspect, the surface temperatures of the heat roller and the press roller described above range from 150 to 180° C.

The 11th aspect of the invention is the image-forming process of one of the 3rd, 9th, and 10th aspects described above. In this aspect, the peripheral speed of the heat roller and the press roller ranges from 70 to 120 mm/second.

The 12th aspect of the invention is the image-forming process of one of the 3rd and 9th to 11th aspects described above. In this aspect, the rubber hardnesses of the heat roller and the press roller described above range from 55 to 85 Asker C hardness and the pressing force between the heat roller and the press roller ranges from 40 to 65 kgf.

The 13th aspect of the invention is the image-forming process of one of the 3rd and 9th to 12th aspects described above. In this aspect, each of the heat roller and the press roller described above has an elastic layer and a surface layer on a core surface in the order, and the rubber hardness of the elastic layer ranges from 10 to 40 Asker C hardness.

DETAILED DESCRIPTION OF THE INVENTION

Then, the present invention is described in detail.

[Preparation of toner for developing electrostatic latent image]

The toner for developing an electrostatic charge image of the invention contains a binder resin, a colorant, a wax, and inorganic fine particles and further, if necessary, contains other component(s).

In the toner of the invention, the temperature at which the complex viscosity η° of the toner in the case of measuring at a frequency of 100 rad/second shows 1000 Pa.s [hereinafter, the temperature is referred to as "Tη°(1000 Pa.s)"] ranges from 125 to 145° C., and the temperature at which the complex viscosity η° of the toner in the case of measuring at a frequency of 100 rad/second shows 100 Pa.s [hereinafter, the temperature is referred to as "Tη°(100 Pa.s)"] ranges from 180 to 210° C.

When the Tη°(1000 Pa.s) is lower than 125° C., the anti-offset property is rapidly lowered, while when it is higher than 145° C., the low-temperature fixing property is deteriorated and the OHP transparency is also lowered. Also, when the Tη°(100 Pa.s) is lower than 180° C., the anti-offset property is lowered and when it is higher than 210° C., the low-temperature fixing property is deteriorated, and it becomes difficult to form a fixed image having a wide color reproducing range and a high optical density.

In the invention, the Tη°(1000 Pa.s) is preferably from 130 to 140° C., and also the Tη°(100 Pa.s) is preferably from 185 to 200° C.

In the toner of the invention, the shape factor SF-1 of the toner shown by the formula (1) is preferably from 130 to 160, and more preferably from 140 to 160. Also, the shape factor SF-2 of the toner shown by the formula (2) is preferably from 110 to 140, and more preferably from 120 to 140.

In the invention, the shape factor of the toner is calculated by the following measurement method. The shape factor is used as a factor for expressing the shape, etc., of the toner, is based on a statistic technique of an image analysis capable of quantitatively analyzing at high precision, the area, the length, the form, etc., of the image picked up by an optical microscope, etc., and can be measured by an image analyzer (LUZEX 5000, manufactured by Nippon Regulator Co., Ltd.).

As is clear from the formula (1), SF-1 is the numerical value obtained by multiplying the maximum length of the diameter of a toner particle by itself, dividing the value obtained by the area of the toner particle, multiplying the value obtained by $\pi/4$, and further multiplying the value obtained by 100. When the form of the toner particle more resembles a sphere, SF-1 becomes the value more near 100, while, on the contrary, when the toner particle is more slender, the value becomes larger. That is, SF-1 shows the difference between the maximum diameter and the minimum diameter of a toner particle, that is, shows a distortion. Also, as is clear from the formula (2), SF-2 is the numerical value obtained by multiplying the peripheral length of the projected image of a toner particle by itself, dividing the value obtained by the area of the toner particle, multiplying the value obtained by $\frac{1}{4}\pi$, and further multiplying the value obtained by 100. When the form of the toner particle more resembles a sphere, SF-2 becomes the value more near 100, and when the peripheral form of the toner particle is more complicated, the value becomes larger. That is, SF-2 represents the surface area (unevenness) of the toner. When the toner is a complete sphere, SF-1=SF-2=100.

The exposed area of a wax on the surface of the toner is larger, the fixing property is better, which is attained when the toner becomes amorphous. On the contrary, when the toner particle more resembles a sphere, that is, when SF-1 is smaller than 130 and SF-2 is smaller than 110, the exposed area of a wax on the toner surface becomes smaller and the fixing temperature width capable of fixing without causing offset becomes narrower. However, when the toner particle becomes too amorphous, for example, when SF-1 is larger than 160 and SF-2 is larger than 140, although there is no problem about fixing, an uneven developer layer forms on a development sleeve to cause uneven images to form images having low quality.

(Inorganic fine particles)

The toner of the invention contains inorganic fine particles in an amount from 1 to 10% by weight to the toner. By containing from 1 to 10% by weight inorganic fine particles in the inside of the toner, it is possible to make the $T\eta°$(1000 Pa.s) from 125 to 145° C. and the $T\eta°$(100 Pa.s) from 180 to 210° C. This is because by adding the addition the inorganic fine particles in the addition amount of the range to the toner, the complex viscosity is not changed at a low temperature but at a high temperature, the temperature gradient of the complex viscosity can be controlled such that the complex viscosity becomes larger than that of toner without containing inorganic fine particles.

When the content of the inorganic fine particles to the toner is less than 1% by weight, it becomes difficult to satisfy the two conditions in regard to the complex viscosity. That is, when the molecular weight is controlled so that the condition of 125° C.$\leqq T\eta°$(1000 Pa.s)$\leqq$145° C. can be satisfied, the complex viscosity at a high temperature become small and the condition of 180° C.$\leqq T\eta°$(100 Pa.s) $\leqq$210° C. cannot be satisfied, whereby the anti-offset property is lowered and in the case of a high image density, image defects occur. Also, when the molecular weight is controlled so that the condition of 180° C.$\leqq T\eta°$(100 Pa.s) $\leqq$210° C. can be satisfied, the condition of 125° C.$\leqq T\eta°$ (1000 Pa.s)$\leqq$145° C. cannot be satisfied, whereby the low-temperature fixing property is deteriorated.

On the other hand, when the content of the inorganic fine particles to the toner exceeds 10% by weight, the surface of the toner image after fixing is not unified and the surface of the fixed image having unevenness is formed. In a color image, by the unevenness of the surface of the fixed image, the color reproducing region is narrowed, the glossiness is liable to be lowered, and it is liable to become difficult to cope with full color. It is preferred that the inorganic fine particles are incorporated in the toner in an amount from 2 to 7% by weight to the toner.

The toner of the invention contains a binder resin, a colorant, a wax, etc., and by dispersing the inorganic fine particles in the inside of the toner, it becomes possible to fine and unify the dispersion of the wax. Furthermore, by finely dispersing the inorganic fine particles in the inside of the toner, the storage elastic modulus of the toner becomes large and the anti-offset property is greatly improved.

As the inorganic fine particles used in the invention, the fine particles of a known inorganic compound, such as silica, alumina, titania, etc., can be used without any restriction. They can be used singly or as a mixture of two or more kinds of them. In the invention, in these materials, from the view point of the OHP transparency, silica having a refractive index smaller than that of the binder resin is preferred.

The mean primary particle size of the inorganic fine particles is preferably from 5 to 100 nm, and more preferably from 10 to 40 nm.

As the practical fine particles of silica, in addition to anhydrous silica, a silica containing aluminum silicate, sodium silicate, potassium silicate, etc., may be used but the silica composition having a refractive index of 1.5 or lower is preferably used.

Also, the inorganic fine particles may be subjected to a surface treatment using various methods. For example, the inorganic fine particles surface-treated with a silane-base coupling agent, a titanium-base coupling agent, a silicone oil, etc., can be preferably used.

(Binder resin)

In the invention, for satisfying the complex viscosity characteristics of the toner, it is preferred to prepare the toner using two or more kinds of binder resins. When the toner is prepared using one kind of a binder resin, even when the $T\eta°$(1000 Pa.s) is controlled to the range from 125 to 145° C., the $T\eta°$(100 Pa.s) becomes lower than 180° C., whereby the anti-offset property sometimes becomes insufficient. Also, even when the $T\eta°$(100 Pa.s) is controlled to the range from 180 to 210° C., the $T\eta°$(1000 Pa.s) becomes higher than 145° C., whereby the low-temperature fixing property sometimes becomes insufficient.

This is caused by that by one kind of a binder resin, the control of the complex viscosity is very difficult. In general, the complex viscosity of a binder resin is frequently controlled by the molecular weight distribution. Also, the control of the molecular weight distribution of the binder resin depends upon the synthesis conditions such as the reaction temperature, the reaction time, etc. In a small-scale experiment, there is relatively a freedom in the synthesis conditions and the detailed control of the molecular weight distribution is possible. However, in the production facilities of carrying out a large-scale synthesis, by the restriction of the synthesis conditions caused by the problems of facilities, the molecular weight distribution cannot be controlled in detail. Thus, when it is necessary to carry out the detailed control of the molecular weight distribution as in the present invention in practical production facilities, it is preferred that two or more kinds of binder resins previously prepared are mixed at a desired ratio to prepare a desired molecular weight distribution, and the mixture obtained is used as the binder resin.

Practically, the binder resin of the invention is composed of at least two kinds of a binder resin (A) and a binder resin (B) and it is preferred that the temperature at which the complex viscosity η° of the binder resin (A) in the case of measuring at a frequency of 100 rad/second shows 1000 Pa.s [hereinafter, the temperature is referred to as "Tη°A(1000 Pa.s)"] ranges from 115 to 130° C., and the temperature at which the complex viscosity η° of the binder resin (B) in the case of measuring at a frequency of 100 rad/second shows 100 Pa.s [hereinafter, the temperature is refereed to as "Tη°B(100 Pa.s)"] ranges from 180 to 200° C. By mixing the two kinds of the resins, the complex viscosity characteristics of the toner can be satisfied.

Also, it is preferred that the binder resin (A) and the binder resin (B) described above are a polyester resin, and further it is preferred that the weight average molecular weight (Mw) of the binder resin (A) ranges from 8000 to 18000, the ratio (Mw/Mn) of the weight average molecular weight (Mw) to the number average molecular weight (Mn) of the binder resin (A) ranges from 2 to 4, the softening point thereof ranges from 105 to 115° C., and the weight average molecular weight (Mw) of the binder resin (B) ranges from 20,000 to 35,000, the ratio (Mw/Mn) of the weight average molecular weight (Mw) to the number average molecular weight (Mn) of the binder resin (B) ranges from 3 to 5, and the softening point thereof ranges from 120 to 140° C. It can be attained to satisfy the complex viscosity characteristics of the binder resin (A) and the binder resin (B) with a polyester resin by that the binder resins (A) and (B) have the molecular weight distributions and the softening points described above. It is preferred that the mixing ratio of the resins is in the range of the binder resin (A) to binder resin (B) ranges from 4/6 to 8/2. When the mixing ratio is outside the range, it becomes sometimes difficult to satisfy the complex viscosity characteristics of the toner.

The binder resins used in the invention include the homopolymers and the copolymers of styrenes such as styrene, chlorostyrene, etc.; mono-olefins such as ethylene, propylene, butylene, isoprene, etc.; vinyl esters such as vinyl acetate, vinyl propionate, vinyl benzoate, etc.; α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate, etc.; vinyl ethers such as vinyl methyl ether, vinyl ethyl ether, vinyl butyl ether, etc.; vinyl ketones such as vinyl methyl ketone, vinyl hexyl ketone, vinyl isopropenyl ketone, etc. Particularly, practical binder resins include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, and polypropylene. Furthermore, there are polyester, polyurethane, an epoxy resin, a silicone resin, polyamide, denatured rosin, paraffin, and waxes. They can be used singly or a mixture of two or more kinds thereof.

In these resins, particularly, polyester is effectively used as the binder resin. For example, a polyester resin composed of the polycondensation product obtained using bisphenol A and a polyhydric aromatic carboxylic acid as the main monomer constituents can be preferably used.

The polyester resin used in the invention is synthesized by the polycondensation of a polyol component and a polycarboxylic acid component. The polyol component includes ethylene glycol, propylene glycol, 1,3-butanediol, 1,4-butanediol, 2,3-butanediol, diethylene glycol, triethylene glycol, 1,5-butanediol, 1,6-hexanediol, neopentyl glycol, cyclohexane dimethanol, hydrogenated bisphenol A, a bisphenol A-ethylene oxide adduct, a bisphenol A-propylene oxide adduct, etc.

The polycarboxylic acid component includes maleic acid, fumaric acid, phthalic acid, isophthalic acid, terephthalic acid, succinic acid, dodecenylsuccinic acid, trimellitic acid, pyromellitic acid, cyclohexanetricarboxylic acid, 2,5,7-naphthalene-tricarboxylic acid, 1,2,4-naphthalenetricarboxylic acid, 1,2,5-hexanetricarboxylic acid, 1,3-dicarboxyl-2-methylene-carboxypropanetetramethylenecarboxylic acid, and the anhydrides of them.

The polyester resin preferably used in the invention can be produced by the following method, etc. The polyester having a hydroxyl group is obtained by heating the polycarboxylic acid and the polyol described above to a temperature from 150 to 280° C. with stirring in the existence of a known esterification catalyst to carry out the dehydrocondensation. It is effective to reduce a pressure for improving the reaction rate of the end of reaction. By controlling the heating temperature, the stirring speed, the extent of the reduced pressure, and the reaction time, and by optimizing each of the conditions, the binder resin having the molecular weight distribution as the binder resin (A) or the binder resin (B) can be produced.

Also, as the method of mixing the binder resin (A) and the binder resin (B), there are following methods. That is, there are a method of dissolving the binder resin (A) and the binder resin (B) in a solvent capable of dissolving these resins and after mixing, distilling off the solvent, a method of melt-mixing the binder resin (A) and the binder resin (B) using a kneader such as an extruder, etc.

In the mixing method using the solvent, because the solvent is easily distilled off at a low temperature, after dispersing the solvent solution of the binder resin (A) and the binder resin (B) in water, the solvent can be distilled off from the aqueous dispersion. In the method, after distilling off the solvent, by collecting the dispersed resins from water by filtration following by washing and drying, the binder resin is obtained. As the solvent which can be used in the method, a solvent having a boiling point of not higher than 100° C., which can be easily distilled off, is particularly preferred.

In the melt-mixing method, when the temperature is high at mixing, the ester exchange of the binder resin (A) and the binder resin (B) occurs by the transesterification, whereby the low-temperature fixing property and the anti-offset property are deteriorated. Accordingly, the temperature at mixing is usually not higher than 150° C., preferably not higher than 120° C., and more preferably not higher than 100° C. Also, for restraining the occurrence of the transesterification, a known ester exchange preventing agent can be used.

Also, the softening point of the binder resin is preferably from 90 to 150° C., and more preferably from 100 to 140° C. When the softening point is lower than 90° C., the heat shelf stability is sometimes deteriorated. On the other hand, when the softening point is higher than 150° C., the low-temperature fixing property is sometimes deteriorated.

The glass transition point of the binder resin is preferably from 55 to 75° C., and more preferably from 55 to 70° C. When the glass transition point is lower than 55° C., the heat shelf stability is sometimes deteriorated. On the other hand, when the glass transition point is higher than 75° C., the low-temperature fixing property is sometimes deteriorated.

The acid value of the binder resin is preferably from 5 to 30 and the hydroxyl value thereof is preferably from 5 to 40.

(Colorant)

The colorant used in the invention typically includes, for example, carbon black, Nigrosine, Aniline Blue, Calcoil Blue, Chrome Yellow, Ultramarine Blue, Du Pont Oil Red, Quinolin Yellow, Methylene Blue Chloride, Phthalocyanine Blue, Malachite Green●Oxalate, Lamp Black, Rose Bengal, C.I. Pigment●Red 48:1, C.I. Pigment●Red 122, C.I. Pigment●Red 57:1, C.I. Pigment●Yellow 97, C.I. Pigment●Yellow 12, C.I. Pigment●Blue 15:1, C.I. Pigment●Blue 15:3, etc.

(Wax)

It is preferred that the wax used in the invention has a melting point in the temperature range from 70 to 100° C. and has a melt viscosity from 1 to 200 mPa.s at 110° C. It is more preferred that the wax has a melting point in the temperature range from 80 to 95° C. and has a melt viscosity from 1 to 100 mPa.s at 110° C. When the melting point is lower than 70° C., the changing temperature of the wax is too low, whereby the anti-blocking property is sometimes deteriorated and when the temperature in the copying machine becomes high, the developing property is sometimes deteriorated. On the other hand, when the melting point exceeds 100° C., the changing temperature of the wax is too high and fixing may be carried out at a high temperature but such high-temperature fixing is undesirable in the viewpoint of energy saving. Also, when the melt viscosity of the wax is higher than 200 mPa.s, the eluation of the wax from the toner is weak and thus it sometimes happens that the fix releasing property becomes insufficient.

In the wax, the endothermic initiation temperature in the DSC curve measured by a differential scanning calorimeter is preferably at least 40° C., and more preferably at least 50° C. When the endothermic initiation temperature is lower than 40° C., it sometimes happens that in the copying machine and a toner bottle, the aggregation of the toners occurs. The endothermic initiation temperature depends upon low-molecular weight ones in the molecular weight distribution constituting the wax, and the kinds and the amount of the polar groups of the structure. In general, when the molecular weight of the wax is increased, the endothermic initiation temperature is raised together with the melting point but by such a manner, the low melting point and the low viscosity essentially specific to wax are spoiled. Thus, it is effective to selectively remove these low molecular weight wax components only in the molecular weight distribution of the wax, and as the method, there are methods by a molecular distillation, a solvent fractionation, a gas chromatographic fractionation, etc.

The content of the wax to the toner is preferably from 5 to 10% by weight, and more preferably from 5 to 8% by weight. When the content of the wax is less than 5% by weight, a sufficient fixing latitude (the heat roller temperature range capable of fixing without causing offset of toner) is not obtained. On the other hand, when the content is larger than 10% by weight, the amount of the free wax released from the toner is increased, whereby the holder of a developer is liable to be stained. Also, the powder fluidity of the toner is deteriorated and also, the free wax attaches to the surface of a photoreceptor forming thereon electrostatic latent images, whereby electrostatic latent images cannot sometimes be accurately formed. Furthermore, because the wax is inferior in transparency as compared with the binder resin, it sometimes happens that the transparency of the OHP images, etc., is lowered and a blackish image is projected.

The wax used in the invention includes, for example, a paraffin wax and the derivatives thereof, a montan wax and the derivatives thereof, a microcrystalline wax and the derivatives thereof, a Fischer-Tropach wax and the derivatives thereof, and a polyolefin wax and the derivatives thereof. The derivatives include the oxides, the polymers with a vinyl monomer, and the graft denatured products. In addition to the waxes, alcohols, fatty acids, vegetable waxes, animal waxes, mineral waxes, ester waxes, acid amides, etc., can be utilized. They can be used singly or as a mixture of two or more kinds thereof.

(Other components)

The toner of the invention can further contain at least one kind of a charging controlling agent of controlling an electrostatic charge as an internal additive. Also, the toner may contain a petroleum-base resin for satisfying the grinding property and the heat shelf stability of the toner. The petroleum-base resin is synthesized using, as the raw materials, diolefins and mono-olefins contained in a cracked oil fraction by-produced from an ethylene plant of producing ethylene, propylene, and the like by steam cracking of petroleum.

Furthermore, for more improving the long storage stability, the fluidity, the developing property, and the transferring property of the toner, an inorganic powder and/or a resin powder may be added to the surface of the toner of the invention as an external additive using either singly or in combination. The inorganic powder includes, for example, carbon black, silica, alumina, titania, and zinc oxide, and the resin powder includes, for example, the spherical fine particles of PMMA, nylon, melamine, benzoguanamine, fluorine-base resins, etc., and the amorphous powders of vinylidene chloride, fatty acid metal salts, etc.

The addition amount of the external additive ranges from 0.2 to 4% by weight, and more preferably from 0.5 to 3% by weight to the toner.

[Two-component developer]

The two-component developer of the invention contains the toner for developing an electrostatic latent image of the invention and a carrier.

There is no particular restriction on the carrier if the carrier is a known carrier, and an iron powder-base carrier, a ferrite-base carrier, a surface-coated ferrite carrier, etc., can be used.

[Production method of toner for developing an electrostatic latent image]

The toner for developing an electrostatic latent image of the invention can be preferably produced by a known melt-kneading method. That is, the addition of the internal additive to the insides of the toner particles is carried out by a kneading treatment. In this case, kneading can be carried out using various kinds of heat kneaders. As the heat kneader, there are, for example, a three-roll type kneader, a single screw type kneader, a twin screw type kneader, and a bambury mixer type kneader.

In the production of the toner of the invention, grinding and classification may be optional. Grinding of the kneaded product can be carried out using, for example, a micronizer, ULMAX JET-O-MIZER, KTM (Krypton), and a turbo-mill. Furthermore, an I-type Jet-Mill can be used. For the classification, an elbow jet using Coanda effect, an air classification, etc., can be used, and as a post step, by applying a Hybridization system (manufactured by Nara Kikai Seisakusho K.K.), a MECHANOFUSION system (Manufactured by Hosokawa Micron Corporation), a CRIPTRON System (manufactured by Kawasaki Heavy Industries, Ltd.), etc., the shape can be changed, and the formation of spherical forms by hot blast can be also used.

[Image-forming process]

The image-forming process of the invention is an image-forming process including a latent image-forming step of forming an electrostatic latent image on a latent image holding member, a developing step of developing the electrostatic latent image with a toner to form a toner image, a transfer step of transferring the toner image onto a transfer material to form a transferred image, and a fixing step of fixing the transferred image using a heat roller and a press roller, wherein the toner is the toner for developing an electrostatic latent image of the 1st aspect of the invention described above, fixing surfaces, of the heat roller and the press roller are formed with a fluorine resin, and a releasing liquid is not substantially supplied to the fixing surfaces.

According to the image-forming process of the invention, images excellent in the low-temperature fixing property, the OHP transparency, and the anti-offset property, having a high glossiness, and having no image defects can be formed.

The fixing surfaces of the heat roller and the press roller used in the invention are formed with a fluorine resin and it is preferred that each of the rollers has a surface layer formed with the fluorine resin and an elastic layer provided on a core surface. The rubber hardness of the elastic layer ranges preferably from 10 to 40, and more preferably from 20 to 40 Asker C hardness. Also, the rubber hardness of each of the heat roller and the press roller in the state of forming the surface layer on the surface ranges preferably from 55 to 85, and more preferably from 60 to 80 Asker C hardness.

In the fixing process using the heat roller and the press roller, fixing is carried out by pressing the heat roller and the press roller against each other to form a nip region. The unfixed toner transferred onto a recording medium is melted by heating in the nip region to form a fixed image on the recording medium. In this case, the time t (millisecond) of heat-pressing the unfixed toner is when the width of the nip region is w (nm) and the peripheral speed of the rollers is v (mm/second), shown by t=w/v. Thus, when the width of the nip region is wide, the time that heat is conducted to the unfixed toner becomes long. In the case of the toners for full color, it is required that the toners are transferred onto the recording medium in an overlapped state and are melt-mixed and thus it is necessary to more sufficiently conduct heat to the toners than the case of a toner for black and white images. Accordingly, for fixing full color toners, it becomes necessary to widen the nip width.

When the rubber hardness of the heat roller and the press roller described above is lower than 55 Asker C hardness, the durability of the rollers becomes sometimes inferior. On the other hand, when the rubber hardness thereof exceeds 85 Asker C hardness, because the rollers are hard, in order to ensure the wide nip width, a load is increased, whereby it sometimes happens that the heat roller is defected, which causes the formation of paper creases and uneven fixing. In this case, it is preferred that the hardness of the elastic layer ranges from 10 to 40 Asker C hardness. By making the hardness of the elastic layer the low hardness as the range, the nip width can be widened at a low load, and the rubber hardness of the heat roller and press roller can be realized. Also, by using such heat roller and press roller, the pressing force of the heat roller and the press roller can be established to a low pressure from 40 to 65 kgf and fixed images without paper creases and uneven fixing can be formed.

In the fixing step of the image-forming process of the invention, the amount of a releasing liquid such as a silicone oil, etc., coated on the heat roller is effective as small as possible. A releasing liquid is effective for the fixing latitude but because the releasing liquid is transferred to the transfer material to be fixed, stickiness occurs and also there are problems that a tape cannot be stuck to the transfer material, letters cannot be added by writing with a felt-tip pen, etc. This is remarkable on OHP. Also, because the releasing liquid cannot make smooth the roughness of the surface of the fixed image on the transfer material, it causes lowering the OHP transparency.

Since the construction of the toner of the invention shows a sufficient fixing latitude, a releasing liquid such as a silicone oil, etc., coated on the heat roller may not substantially be used. However, in the case of coping with high-speed printing, a slight amount of the releasing liquid may be supplied. In the case, the supplying amount thereof may be not more than 1 $\mu$ liter per one A4 paper. When the amount of the releasing liquid is in the range, the occurrence of the problems can be substantially avoided.

In the image-forming process of the invention, fixed images having a high glossiness can be obtained. Because the glossiness of a fixed image largely depends upon the structure of the fixed apparatus and the fixing conditions, it is difficult to obtain the high glossiness in all conditions, but in the invention, the high glossiness can be obtained in the condition below. That is, in the invention, in the state of substantially not supplying a releasing liquid to the surface of the heat roller, using a recording paper having a basis weight from 50 to 120 g/m$^2$ as the recording material, and when the toner image is fixed to the recording paper by heat-pressing under the conditions that the surface temperature of the heat roller and then press roller range from 150 to 180° C. and the peripheral speed of the heat roller and the press roller ranges from 70 to 120 mm/second, a fixed image having a glossiness (75 degree gloss) from 40 to 60 can be formed when the toner carried amount formed on the recording paper is 0.50 mg/cm$^2$. The image having such a high glossiness is suitable for pictorial image and an OHP image, and gives a full color image having a high quality.

Then, the examples of the invention are described below but the invention is not limited to these examples. In addition, all "parts" in the examples, unless otherwise indicated, are "by weight".

Preparation of binder resin

The monomers are selected as shown in Table 1 below and six kinds of polyester resins having various complex viscosity characteristics are prepared. Also, as the wax, the three kinds of waxes shown in Table 2 below are used.

TABLE 1

| | Tη.A 1000 Pa.s) | Tη.B (100 Pa.s) | Mw/ Mw | Softening Mn | point | Monomers |
|---|---|---|---|---|---|---|
| Polyester resin 1 | 116° C. | 139° C. | 9800 | 2.79 | 108° C. | Terephthalic acid/bisphenol A-kpropylene oxide adduct/cyclohexane dimethanol |
| Polyester resin 2 | 124° C. | 148° C. | 10200 | 3.07 | 114° C. | Terephthalic acid/bisphenol A-etheylene oxide adduct/cyclohexane dimethanol |
| Polyester | 145° C. | 188° C. | 24300 | 3.55 | 132° C. | Terephthalic acid/bisphenol |

TABLE 1-continued

| | Tη.A 1000 Pa.s) | Tη.B (100 Pa.s) | Mw/ Mw | Softening Mn | point | Monomers |
|---|---|---|---|---|---|---|
| resine 3 | | | | | | A-propylene oxide adduct |
| Polyester resin 4 | 151° C. | 193° C. | 28800 | 3.89 | 139° C. | Terephthalic acid/bisphenol A-propylene oxide adduct |
| Polyester resin 5 | 100° C. | 125° C. | 7800 | 2.25 | 95° C. | Terephthalic acid/bisphenol A-ethylene oxide adduct/bisphenol A-propylene oxide adduct |
| Polyester resin 6 | 166° C. | 205° C. | 36000 | 7.80 | 148° C. | Terephthalic acid/bisphenol A-ethylene oxide adduct/cyclohexane dimethanol/timellitic acid ethylene glycol |

TABLE 2

| | Content of wax | Melting point (° C.) | Melt viscosity at 110° C. (mPa.s) |
|---|---|---|---|
| Wax A | Granular purified carnauba wax | 83 | 50 |
| Wax B | Microcrystalline wax | 85 | 110 |
| Wax C | Heptatroiacontanol oxalate | 103 | 150 |

In addition, the complex viscosity characteristics and the molecular weights in Table 1 are measured by the following methods.

Measurement of complex viscosity

The measurement of the complex viscosity is carried out under the following conditions. For the measurement, an apparatus, ARES-2KFRT manufactured by Rheometric Scientific Co., Ltd. is used. As the sample, a flat plate having a diameter of 25 mm is used and the sample is deformed at a thickness of 1.8 mm. Prior to the measurement of the complex viscosity, the strain dependence of a storage elastic modulus is measured at a frequency of 100 rad/s, a temperature range from 100 to 250° C., and an interval of 10° C. to obtain the strain region that the storage elastic modulus and the strain are in a linear relation. The strain is controlled per each temperature such that the measurement can be carried out in the linear region of the strain, the complex viscosity is measured at a frequency of 100 rad/s, in the temperature-raising condition of 1° C./minute, and a temperature range of 100 to 250° C.

Measurement of molecular weight

The molecular weight is measured under the following conditions. An apparatus, HLC-8120GPC, SC-8020 manufactured by TOSOH CORPORATION is used, as a column, TSK gel, Super HM-H (6.0 mm ID×15 cm×2) is used, and as an eluent, THF (tetrahydrofuran) is used. As the experimental conditions, the sample concentration is 0.5%, the flow rate is 0.6 ml/minute, the sample injection amount is 10μ liter, the measurement temperature is 40° C., and the calibration curve is prepared from 10 samples of A-500, F-1, F-10, F-80, F-380, A-2500, F-4, F-40, F-128, and F-700.

EXAMPLE 1

Preparation of toner 1

Composition of magenta toner 1

- Polyester resin 1 62 parts
- Polyester resin 4 25 parts
- Magenta pigment (C.I. Pigment●Red 57:1) 5 parts
- Silica finer particles (mean primary particle size 16 nm, R972: made by Nippon Aerosil K.K.) 3 parts
- Wax A 5 parts Composition of cyan toner 1

- Polyester resin 1 65 parts
- Polyester resin 4 24 parts
- Cyan pigment (C.I. Pigment●Blue 15:3) 3 parts
- Silica finer particles (mean primary particle size 16 nm, R972: made by Nippon Aerosil K.K.) 3 parts
- Wax A 5 parts Composition of yellow toner 1

- Polyester resin 1 61 parts
- Polyester resin 4 22 parts
- Yellow pigment (C.I. Pigment●Yellow 17) 9 parts
- Silica fine particles (mean primary particle size 16 nm, R 972: made by Nippon Aerosil K.K.) 3 parts
- Wax A 5 parts Composition of black toner 1

- Polyester resin 1 62 parts
- Polyester resin 4 25 parts
- Black pigment (carbon black) 5 parts
- Silica fine particles (mean primary particle size 16 nm, R 972: made by Nippon Aerosil K.K.) 3 parts
- Wax A 5 parts The mixture of each of the compositions is kneaded by an extruder, and after grinding by a grinder of an surface grinding system, fine particles and crude particles are classified by an air classifier to obtain a magenta toner 1, a cyan toner 1, a yellow toner 1, and a black toner 1 each having $d_{50}$=6.7 μm.

EXAMPLE 2

Preparation of toner 2

Composition of magenta toner 2

- Polyester resin 1 45 parts
- Polyester resin 4 40 parts
- Magenta pigment (C.I. Pigment●Red 57:1) 5 parts
- Silica fine particles (mean primary particle size 16 nm, R972: made by Nippon Aerosil K.K.) 5 parts
- Wax B 5 parts Composition of cyan toner 2

- Polyester resin 1 46 parts
- Polyester resin 4 41 parts
- Cyan pigment (C.I. Pigment●Blue 15:3) 3 parts
- Silica fine particles (mean primary particle size 16 nm, R972: made by Nippon Aerosil K.K.) 5 parts Wax B 5 parts Composition of yellow toner 2

Polyester resin 1 40 parts

Polyester resin 4 41 parts

Yellow pigment (C.I. Pigment●Yellow 17) 9 parts

Silica fine particles (mean primary particle size 16 nm, R 972: made by Nippon Aerosil K.K.) 5 parts Wax B 5 parts Composition of black toner 2

Polyester resin 1 43 parts

Polyester resin 4 42 parts

Black pigment (carbon black) 5 parts

Silica fine particles (mean primary particle size 16 nm, R 972: made by Nippon Aerosil K.K.) 5 parts Wax B 5 parts The mixture of each of the compositions is kneaded by an extruder, and after grinding by a grinder of an surface grinding system, fine particles and crude particles are classified by an air classifier to obtain a magenta toner 2, a cyan toner 2, a yellow toner 2, and a black toner 2 each having $d_{50}$=6.1 μm.

EXAMPLE 3

Preparation of toner 3

Composition of magenta toner 3

Polyester resin 2 55 parts

Polyester resin 4 30 parts

Magenta pigment (C.I. Pigment●Red 57:1) 5 parts

Silica fine particles (mean primary particle size 16 nm, R 972: made by Nippon Aerosil K.K.) 5 parts Wax A 5 parts Composition of cyan toner 3

Polyester resin 2 56.3 parts

Polyester resin 4 30.7 parts

Cyan pigment (C.I. Pigment●Blue 15:3) 3 parts

Silica fine particles (mean primary particle size 16 nm, R 972: made by Nippon Aerosil K.K.) 5 parts Wax A 5 parts Composition of Yellow toner 3

Polyester resin 2 52.4 parts

Polyester resin 4 28.6 parts

Yellow pigment (C.I. Pigment●Yellow 17) 9 parts

Silica fine particles (mean primary particle size 16 nm, R 972: made by Nippon Aerosil K.K.) 5 parts Wax A 5 parts Composition of black toner 3

Polyester resin 2 55 parts

Polyester resin 4 30 parts

Black pigment (carbon black) 5 parts

Silica fine particles (mean primary particle size 16 nm, R 972: made by Nippon Aerosil K.K.) 5 parts Wax A 5 parts The mixture of each of the compositions is kneaded by an extruder, and after grinding by a grinder of an surface grinding system, fine particles and crude particles are classified by an air classifier to obtain a magenta toner 3, a cyan toner 3, a yellow toner 3, and a black toner 3 each having $d_{50}$=6.8 μm.

COMPARATIVE EXAMPLE 1

Preparation of toner 4

Composition of magenta toner 4

Polyester resin 2 90 parts

Magenta Pigment (C.I. Pigment●Red 57:1) 5 parts

Wax A 5 parts

Composition of cyan toner 4

Polyester resin 2 92 parts

Cyan Pigment (C.I. Pigment●Blue 15:3) 3 parts

Wax A 5 parts

Composition of yellow toner 4

Polyester resin 2 86 parts

Yellow Pigment (C.I. Pigment ●Yellow 17) 9 parts

Wax A 5 parts

Composition of black toner 4

Polyester resin 2 90 parts

Black pigment (carbon black) 5 parts

Wax A 5 parts

The mixture of each of the compositions is kneaded by an extruder, and after grinding by a grinder of an surface grinding system, fine particles and crude particles are classified by an air classifier to obtain a magenta tone 4, a cyan toner 4, a yellow toner 4, and a black toner 4 each having $d_{50}$=6.6 μm.

COMPARATIVE EXAMPLE 2

Preparation of toner 5

Composition of magenta toner 4

Polyester resin 5 70 parts

Polyester resin 6 20 parts

Magenta Pigment (C.I. Pigment●Red 57:1) 5 parts

Wax B 5 parts

Composition of cyan toner 5

Polyester resin 5 71.6 parts

Polyester resin 6 20.4 parts

Cyan Pigment (C.I. Pigment●Blue 15:3) 3 parts

Wax B 5 parts

Composition of yellow toner 5

Polyester resin 5 66.9 parts

Polyester resin 6 19.1 parts

Yellow Pigment (C.I. Pigment●Yellow 17) 9 parts

Wax B 5 parts

Composition of black toner 5

Polyester resin 5 80 parts

Polyester resin 6 10 parts

Black pigment (carbon black) 5 parts

Wax B 5 parts

The mixture of each of the compositions is kneaded by an extruder, and after grinding by an I type jet mill grinder for a shortened residence time, fine particles and crude particles are classified by an air classifier to obtain a magenta toner 5, a cyan toner 5, a yellow toner 5, and a black toner 5 each having $d_{50}$=7.6 μm.

COMPARATIVE EXAMPLE 3

Preparation of toner 6

Composition of magenta toner 6

Polyester resin 1 36 parts

Polyester resin 4 49 parts

Magenta Pigment (C.I. Pigment●Red 57) 5 parts

Silica fine particles (mean primary particle size 16 nm, R972: made by Nippon Aerosil K.K.) 5 parts Wax C 5 parts Composition of cyan toner 6

Polyester resin 1 38 parts

Polyester resin 4 49 parts
Cyan Pigment (C.I. Pigment●Blue 15:3) 3 parts
Silica fine particles (mean primary particle size 16 nm, R 972: made by Nippon Aerosil K.K.) 5 parts
Wax C 5 parts Composition of yellow toner 6
Polyester resin 1 36 parts
Polyester resin 4 45 parts
Yellow Pigment (C.I. Pigment●Yellow 17) 9 parts
Silica fine particles (mean primary particle size 16 nm, R 972: made by Nippon Aerosil K.K.) 5 parts
Wax C 5 parts Composition of black toner 6
Polyester resin 1 36 parts
Polyester resin 4 49 parts
Black Pigment (carbon black) 5 parts
Silica fine particles (mean primary particle size 16 nm, R 972: made by Nippon Aerosil K.K.) 5 parts
Wax C 5 parts The mixture of each of the compositions is kneaded by an extruder, and after grinding by a grinder of an surface grinding system, fine particles and crude particles are classified by an air classifier to obtain a magenta toner 6, a cyan toner 6, a yellow toner 6, and a black toner 6 each having $d_{50}$=6.8 μm.

About the magenta toner 1, the cyan toner 1, the yellow toner 1, and the black toner 1 obtains as described above, the complex viscosity characteristics and the molecular weight of each color toner are measured by the same methods of the measurements of the complex viscosity characteristics and the molecular weight of the binder resin described above, and the mean values of these values obtained are employed as the complex viscosity characteristics and the molecular weight in regard to the toner 1. Also, by an image analyzer (Luzex 5000, manufactured by Nippon Regulator Co., Ltd.), SF-1 and SF-2 of each color toner are measured and the mean values of these values obtained are employed as SF-1 and SF-2 of toner 1. Similarly, about the toners 2 to 6, these values are measured and the results are shown in Table 3 below.

TABLE 3

| | Toner | Tη* 1000 Pa.s) | Tη* (100 Pa.s) | Mw | Mw/Mn | SF-1 | SF-2 |
|---|---|---|---|---|---|---|---|
| Example 1 | Toner 1 | 132 | 180 | 15000 | 3.36 | 143 | 119 |
| Example 2 | Toner 2 | 138 | 186 | 17800 | 3.88 | 143 | 115 |
| Example 3 | Toner 3 | 143 | 189 | 16700 | 4.08 | 141 | 115 |
| Comparative Example 1 | Toner 4 | 128 | 168 | 10200 | 3.07 | 141 | 118 |
| Comparative Example 2 | Toner 5 | 125 | 163 | 11400 | 3.66 | 161 | 141 |
| Comparative Example 3 | Toner 6 | 153 | 208 | 21900 | 9.18 | 145 | 121 |

Preparation of developer

To 100 parts of the toner of each color obtained as described above are added 1.0 part of negative-charging silica and 0.5 part of negative-charging titania to provide an external-added toner. By mixing 100 parts of a carrier obtained by coating ferrite having a particle size of 50 μm with a styrene-methyl methacrylate copolymer and 6 parts of the external-added toner, a developer of each color is prepared.

Image formation

Using these developers, a copy test is carried out by a test machine obtained by reconstructing the electrophotographic copying machine (A-Color 935, manufactured by FUJI XEROX CO., LTD.). In this case, as the heat roller and the press roller, a heat roller and a press roller each having a rubber hardness of 75 Asker C hardness and each having an elastic layer using a rubber having 24 Asker C hardness and a thickness of 7.5 mm and a surface layer formed by covering the surface of the elastic layer with polytetrafluoroethylene tube having a thickness of 20 μm are used. Also, the pressing force of the hear roller and the press roller is established to 55 kgf and in this case, the peripheral speeds of the heat roll and the press roll are established to 100 mm/second.

For the test, each solid unfixed toner image having a length of 5 cm and a width of 4 cm is formed on a transfer paper of A4 having a basis weight of 100 g/m$^2$ for the electrophotographic copying machine (A-Color 935, manufactured by FUJI XEROX CO., LTD.). In this case, the toner image is formed such that the toner amount on the transfer paper became 0.5 mg/cm$^2$ or 1.5 mg/cm$^2$. In addition, the unfixed toner image having the toner amount of 1.5 mg/cm$^2$ is prepared by overlapping toner images of three colors by controlling such that each toner amount of yellow, magenta, cyan became 0.5 mg/cm$^2$.

Evaluations of anti-offset property and glossiness

Using the solid unfixed toner image having a three color overlapped toner amount of 1.5 mg/cm$^2$ and using a test machine obtained by reconstructing the copying machine A-Color 935 such that the heat roller temperature and the press roller temperature can be freely established and can be monitored, the test is carried out in the state of substantially not existing a releasing oil by stopping the supply of the releasing oil to the heat roller. That is, the surface temperature of the heat roller is stepwise changed and at each surface temperature, fixing of the unfixed toner image is carried out using the transfer paper carrying the toner image. In this case, whether or not a toner strain occurs from the heat roller on blank portions of the paper is observed, and the temperature region of not causing stains is defined as a non-offset temperature region. Also, the glossiness of the test sample in the fixing temperature of 160° C. is measured at two points in the sample plane using Gloss Meter (manufactured by Murakami Shikisai Kogaku Kenkyusho) and the difference of the glossinesses is obtained as the in-plane glossiness difference. In this case, the measurement condition of the glossiness is 75 degree. The measurement results are shown in Table 4 below.

The anti-offset property is evaluated as follows. That is, the case of the offset-occurring temperature is 190° C. or higher is evaluated as A, the case of 180° C. or higher but lower than 190° C. is B, the case of 170° C. or higher but lower than 180° C., is C, and the case of lower than 170° C. is D. About the in-plane glossiness difference, the case of lower than 3 is evaluated as A, the case of 3 or higher but lower than 5 is B, the case of 5 or higher but lower than 10 is C, and the case of higher than 10 is D.

Evaluation of low-temperature fixing property

Using the solid unfixed toner image of the toner amount of 0.5 mg/cm$^2$, the test is carried out in the state of substantially not existing a releasing oil on the surface of the heat roller by stopping the supply of the releasing oil to the heat roller with an interval of 5° C. at from 130 to 200° C. The experiment is carried out to each of three colors of yellow, magenta, and cyan. In this case, the glossiness of 75 degree of the fixing sample is measured using Gloss Meter (manufactured by Murakami Shikisai Kogaku Kenkyusho) and the temperature at which the glossiness showed 40 is determined respectively. The mean value of the experimental results on the three colors of yellow, magenta, and cyan is shown in Table 4 below.

In the low-temperature property, the case the fixing temperature at which the glossiness is 40 is lower than 160° C. is evaluated as A, the case that the temperature is 160° C. but lower than 165° C. is B, the case that the temperature is 165° C. or higher but lower than 170° C. is C, and the case that the temperature is 170° C. or higher is D.

Evaluation of OHP transparency

Using the solid unfixed toner image of the toner amount of 0.5 mg/cm$^2$, the test at 160° C. is carried out in the state of substantially not existing a releasing oil on the surface of the heat roller by stopping the supply of the releasing oil to the heat roller. The experiment is carried out to each of three colors of yellow, magenta, and cyan. The ratio of the incident light to the transmitted light of the fixed image is obtained and defines to be the OHP transmittance. Practically, as the incident light component of the transmitted light, the value of condensed at the potential angle of 3.5 degree is used, and by the ratio to the value condensed at the potential angle of 45 degree, the light transmitted is obtained. The mean value of the experimental results of three colors of yellow, magenta, and cyan are shown in the Table 4 below. In the OHP transparency, the case of at least 80% is evaluated as A, the case of 70% or higher but lower than 80% is B, the case of 60% or higher but lower than 70% is C, and the case of lower than 60% is D.

TABLE 4

| | Toner | Temp. (° C.) of glossiness 40 | Low-temp. fixing property | Offset Temperature (° C.) | Anti-offset property | OHP trans-Parancey (%) | In-plane glossiness difference |
|---|---|---|---|---|---|---|---|
| Example 1 | Toner 1 | 156 | A | 184 | B | 76(B) | 4.3(B) |
| Example 2 | Toner 2 | 162 | B | 196 | A | 73(B) | 2.6(A) |
| Example 3 | Toner 3 | 158 | A | 200 | A | 81(A) | 2.2(A) |
| Comparative Example 1 | Toner 4 | 137 | A | 156 | D | 63(C) | 13.4(D) |
| Comparative Example 2 | Toner 5 | 146 | A | 163 | D | 77(B) | 15.6(D) |
| Comparative Example 3 | Toner 6 | 173 | D | 218 | A | 52(D) | 3.8(B) |

From the results of Table 4, it can be seen that by using the toners 1 to 3 of the invention in Examples 1 to 3 wherein the Tη*(1000 Pa●s) satisfies the condition from 125 to 145° C. and the Tη*(100 Pa●s) satisfies the condition of 180 to 210° C., the low-temperature fixing property, the anti-offset property, and the OHP transparency are excellent. Also, the in-plane glossiness difference is very small and there are no image defects.

On the other hand, in the toner 4 of Comparative Example 1, the Tη*(1000 Pa●s) satisfies the condition from 125 to 145° C. but because the toner uses only one kind of resin, the Tη*(100 Pa●s) cannot satisfy the condition from 180 to 210° C., whereby the anti-offset property is inferior and image defects occur.

Also, the toner 5 of Comparative Example 2 is prepared by mixing two kinds of resins but because each of the two kinds of the resins does not satisfy the complex viscosity of resins does not satisfy the complex viscosity characteristics of the resin defined as a preferred one in the invention, and thus although the Tη*(1000 Pa●s) satisfies the condition from 125 to 145° C. the Tη*(100 Pa●s) cannot satisfy the condition from 180 to 210° C., whereby in the case of the toner, the anti-offset property is inferior and image defects occur. Also, in the toner, because SF-1 does not satisfy the condition from 130 to 160 and SF-2 does not satisfy the condition from 110 to 140, the transferring property of the toner becomes insufficient and a deletion occurs in the inside of the solid image formed.

Furthermore, the toner 6 of Comparative Example 3 contains inorganic fine particles in the inside of the toner and is prepared by mixing two kinds of resins satisfying the complex viscosity characteristics of resin defined as a preferred one in the invention, but because the Tη*(1000 Pa●s) cannot satisfy the condition from 125 to 145° C. and the Tη*(100 Pa●s) cannot satisfy the condition from 180 to 210° C., the toner is inferior in the low-temperature fixing property and the OHP transparency. Also, because the viscosity of the wax used is high, particularly, the OHP transparency is greatly inferior.

As described above in detail, according to the present invention, an electrostatic latent image developing toner which can realize images being excellent in the low-temperature fixing property, the OHP transparency, and the anti-offset property without substantially coating oil in heat roll fixing, having a high glossiness of images, and having no image defects even when the image density is high; a two-component developer containing the toner, and an image-forming process using the toner can be provided.

What is claimed is:

1. A toner for developing an electrostatic latent image comprising a binder resin (A), a colorant and a wax, wherein the temperature at which the complex viscosity η* of the toner in the case of measuring at a frequency of 100 rad/second shows 1000 Pa.s is in the range from 125 to 145° C., and the temperature at which the complex viscosity η* of the toner in the case of measuring at a frequency of 100 rad/second shows 100 Pa.s in the range from 180 to 210° C., wherein the softening point of the binder resin (A) ranges from 105 to 115° C.

2. The toner for developing an electrostatic latent image according to claim 1, wherein the toner comprises 1 to 10% by weight of inorganic fine particles.

3. The toner for developing an electrostatic latent image according to claim 1, wherein the binder resin further comprises an additional binder resin (B), the temperature at which the complex viscosity η* of the binder resin (A) in the case of measuring at a frequency of 100 rad/second shows 1000 Pa.s in the range from 115 to 130° C., and the temperature at which the complex viscosity $\eta^*$ of the binder resin (B) in the case of measuring at a frequency of 100 rad/second shows 100 Pa.s in the range from 180 to 200 ° C.

4. The toner for developing an electrostatic latent image according to claim 3, wherein the weight average molecular weight (Mw) of the binder resin (A) ranges from 8000 to 18,000 , the ratio (Mw/Mn) of the weight average molecular weight (Mw) to the number average molecular weight (Mn) thereof ranges from 2 to 4.

5. The toner for developing an electrostatic latent image according to claim 3, wherein the weight average molecular weight (Mw) of the binder resin (B) ranges from 20,000 to 35,000 the ratio (Mw/Mn) of the weight average molecular weight (Mw) to the number average molecular weight (Mn) thereof ranges from 3 to 5, and the softening point thereof ranges from 120 to 140° C.

6. The toner for developing an electrostatic latent image according to claim 1, wherein the shape factor SF-1 of the toner shown by the following formula (1) ranges from 130 to 160 and the shape factor SF-2 of the toner shown by the following formula (2) ranges from 110 to 140:

$$SF-1 = \frac{(\text{The maximum length of the diameter of toner particle})^2}{(\text{Area of toner particle})} \times \frac{\pi}{4} \times 100 \quad (1)$$

$$SF-2 = \frac{(\text{Peripheral length of the projected image of toner particle})^2}{\text{Area of toner particle}} \times \frac{1}{4\pi} \times 100 \quad (2)$$

7. The toner for developing an electrostatic latent image according to claim 1, wherein the wax has a melting point in the temperature range from 70 to 100° C.

8. The toner for developing an electrostatic latent image according to claim 1, wherein the wax has a melt viscosity in the range from 1to 200 mPa●s at 110° C.

9. The toner for developing an electrostatic latent image according to claim 1, wherein the toner comprises the wax content in the range from 5 to 10% by weight.

10. The toner for developing an electrostatic latent image according to claim 1 wherein the toner is a color toner.

11. An image-forming process comprising the steps of:

forming an electrostatic latent image on a latent image holding member;

developing the electrostatic latent image with a toner to form a toner image;

transferring the toner image onto a transfer member to form a transferred image; and fixing the transferred image on a recording medium using a fixing apparatus, having a fixing surface, wherein the toner is the toner of claim 1, the fixing apparatus comprising a releasing resin on the fixing surface, and a releasing liquid is not substantially supplied to the fixing surface.

12. The image-forming process according to claim 11, wherein when the toner amount of the toner image formed on the recording medium is 0.50 mg/cm$^2$, the glossiness (75 degree gloss) thereof ranges from 40 to 60.

13. The image-forming process according to claim 11, wherein the fixing apparatus comprises both a heat roller and a press roller, in which the releasing liquid is not substantially applied to both the heat roller and the press roller.

14. The image-forming process according to claim 13, wherein the surface temperature of the heat roller ranges from 150 to 180° C.

15. The image-forming process according to claim 13, wherein the peripheral speed of the heat roller and the press roller ranges from 70 to 120 mm/second.

16. The image-forming process according to claim 13, wherein the rubber hardness of the heat roller and the press roller range from 55 to 85 Asker C hardness and the pressing force of the heat roller and the press roller ranges from 40 to 65 kgf.

17. The image-forming process according to claim 13, wherein each of the heat roller and the press roller has a surface layer comprising the releasing resin, which functions as the fixing surface, and an elastic layer provided on a core surface in the order, and the rubber hardness of the elastic layer ranges from 10 to 40 Asker C hardness.

18. The image-forming process according to claim 11, wherein the releasing resin is a fluorine resin.

19. A two component developer comprising a toner and a carrier, the toner containing a binder resin (A), a colorant and a wax, wherein the temperature at which the complex viscosity $\eta^*$ of the toner in the case of measuring at a frequency of 100 rad/second shows 1000 Pa.s is in the range from 125 to 145° C., and the temperature at which the complex viscosity $\eta^*$ of the toner in the case of measuring at a frequency of 100 rad/second shows 100 Pa.s is in the range from 180 to 210 ° C., wherein the softening point of the binder resin (A) ranges from 105 to 115° C.

* * * * *